US011959201B2

(12) United States Patent
Dolle et al.

(10) Patent No.: US 11,959,201 B2
(45) Date of Patent: Apr. 16, 2024

(54) TEXTILE THAT IS BOTH SOFT TO TOUCH AND RESISTANT TO ABRASION AND STRETCHING

(71) Applicant: Serge Ferrari SAS, Saint Jean de Soudain (FR)

(72) Inventors: Anaïs Dolle, Lyons (FR); Emmanuel Tapie, Voiron (FR)

(73) Assignee: Serge Ferrari SAS, Saint Jean de Soudain (FR)

( * ) Notice: Subject to any disclaimer, the term of this patent is extended or adjusted under 35 U.S.C. 154(b) by 236 days.

(21) Appl. No.: 17/284,694

(22) PCT Filed: Oct. 17, 2019

(86) PCT No.: PCT/FR2019/052462

§ 371 (c)(1),
(2) Date: Apr. 12, 2021

(87) PCT Pub. No.: WO2020/079374

PCT Pub. Date: Apr. 23, 2020

(65) Prior Publication Data

US 2021/0340696 A1 Nov. 4, 2021

(30) Foreign Application Priority Data

Oct. 18, 2018 (FR) ..... 1859665

(51) Int. Cl.

| | |
|---|---|
| ***D03D 15/47*** | (2021.01) |
| ***D02G 3/40*** | (2006.01) |
| ***D03D 15/43*** | (2021.01) |
| ***D03D 15/49*** | (2021.01) |
| ***D03D 15/58*** | (2021.01) |
| *D02G 3/24* | (2006.01) |

(52) U.S. Cl.
CPC ..... *D02G 3/408* (2013.01); *D02G 3/402* (2013.01); *D03D 15/43* (2021.01); *D03D 15/47* (2021.01);

(Continued)

(58) Field of Classification Search
CPC ..... D02G 3/408; D02G 3/402; D02G 3/40; D03D 15/43; D03D 15/47; D03D 15/49;

(Continued)

(56) References Cited

U.S. PATENT DOCUMENTS 4,293,604 A * 10/1981 Campbell ..... D04H 11/00 428/95
4,560,604 A * 12/1985 Shimizu ..... D06P 1/0096 428/95
5,082,711 A * 1/1992 Goerens ..... D02G 3/408 428/92
5,100,713 A * 3/1992 Homma ..... D03D 13/002 428/113

(Continued)

FOREIGN PATENT DOCUMENTS

EP 0119684 A1 9/1984
EP 0339965 A1 11/1989
JP 2003328249 A 11/2003

OTHER PUBLICATIONS

International Search Report issued in PCT Patent Application No. PCT/FR2019/052462 dated Mar. 11, 2020.

(Continued)

*Primary Examiner* — Robert H Muromoto, Jr.
(74) *Attorney, Agent, or Firm* — MARSHALL, GERSTEIN & BORUN LLP

(57) ABSTRACT

A woven textile includes, in at least one of the warp or weft directions, non-flocked yarns and flocked yarns. The flocked yarns include a support yarn having a core covered with an adhesive layer. The support yarn has a base diameter. Protruding filaments provide the flocked yarns with an apparent diameter. The non-flocked yarns have a diameter which is smaller than the apparent diameter and larger than the base diameter of the flocked yarns.

13 Claims, 3 Drawing Sheets

(52) U.S. Cl.
CPC ..... *D03D 15/49* (2021.01); *D03D 15/58* (2021.01); *D10B 2321/041* (2013.01); *D10B 2331/02* (2013.01); *D10B 2331/04* (2013.01); *D10B 2401/063* (2013.01); *D10B 2505/08* (2013.01)

(58) Field of Classification Search
CPC .. D03D 15/58; D03D 27/18; D10B 2321/041; D10B 2331/02; D10B 2331/04; D10B 2401/063; D10B 2505/08; D10B 2331/021
See application file for complete search history.

(56) References Cited

U.S. PATENT DOCUMENTS

| | | | | |
|---|---|---|---|---|
| 8,484,940 | B2 * | 7/2013 | Bruner | D04B 1/04 139/393 |
| 8,561,651 | B2 * | 10/2013 | Watanabe | D03D 15/567 139/393 |
| 9,234,304 | B2 * | 1/2016 | Bruner | D04B 1/18 |
| 2007/0135009 | A1 * | 6/2007 | Liao | D03D 15/49 442/209 |
| 2010/0227109 | A1 * | 9/2010 | Susa | D03D 15/43 428/90 |

OTHER PUBLICATIONS

International Preliminary Report on Patentability issued in PCT Patent Application No. PCT/FR2019/052462 dated Jan. 29, 2021.

* cited by examiner

TEXTILE THAT IS BOTH SOFT TO TOUCH AND RESISTANT TO ABRASION AND STRETCHING

FIELD OF THE INVENTION

The present invention relates to woven textiles and more specifically to those comprising flocked yarns. The textiles of the invention are particularly suitable in the interior or outdoor décor fields, more particularly in furnishings, and are used, for example, in the manufacture of covers for seat cushions or decorative cushions.

BACKGROUND

In general, in order to produce textiles with a pleasant feel, the use of "velvet" type textiles is known. These textiles are constituted by a cloth which is smooth on one side while the other side is covered with an upright pile which is very dense, held in by the yarns of the fabric. They are produced using specific technology requiring particular weaving looms and produce very soft products. However, the pile suffers from the dual disadvantage of, on the one hand, being exposed to contact and therefore suffering from abrasion, and on the other hand of having a nap, which modifies the appearance depending on the viewing angle.

Softness may also be obtained by using yarns which are said to be "chenille" yarns. These yarns are constituted by fibres which are trapped by the interlacing of two yarns. Mechanically anchoring the fibres is not sufficient to hold them in the case of severe abrasion. Thus, these yarns are severely squashed following abrasion.

Another possibility for obtaining a soft feel consists of using flocked yarns. The use of woven textiles comprising flocked yarns is widespread. They are particularly valued in the automobile industry for the manufacture of seat coverings. The success of flocked yarns derives from the softness to the touch with which they endow textiles incorporating them.

Flocked yarns are generally constituted by a core covered with an adhesive layer and protruding elements. The softness is provided by filaments which protrude from the core of the flocked yarns. An example of flocked yarns which may be cited are the yarns marketed by YARNTEX TEXTIL, which are electrostatically flocked and composed of a multifilament polyamide core covered with a layer composed of a polyacrylic type adhesive which can be used to secure the flock filaments to the polyamide. In order to obtain the character of softness, the filaments have a portion which is trapped in the adhesive layer and a free portion which protrudes outwards.

The flocked yarns developed to provide a soft feel are thus intended to receive frequent contact by the user. This means that fabrics comprising flocked yarns are subjected to a great deal of abrasion. In particular, the filaments are subjected to high stresses when a person sits on a chair or cushion comprising these yarns with a movement which is a combination of squashing and friction. However, the structure of flocked yarns is such that the peripheral filaments are only partially secured to the core. As a consequence, they can be pulled out and have a tendency to become detached from the core.

Furthermore, the filaments which remain secured to the core have no protection and wear inexorably.

Solutions have been proposed in order to improve the abrasion resistance of Hocked yarns. Patent EP 0 339 965 proposes a production process which can be used to improve the abrasion resistance of a flocked yarn by increasing the density and cohesion of the filaments with the textile core. This approach can be used to limit the phenomenon of pull-out of the filaments.

The patent U.S. Pat. No. 5,082,711 proposes the use of several types of filaments for coating a flocked yarn. The filaments with the best abrasion resistance are longer than the filaments which have the weaker abrasion resistance. This approach can be used to limit the phenomenon of wear.

Although these solutions provide satisfactory results for the yarns taken individually, the fabrics produced from these flocked yarns remain subject to abrasion phenomena. Furthermore, the flocked yarns cannot have sufficient mechanical properties, for example stretch resistance. This is particularly important when the fabric is stressed mechanically and in a regular manner, such as on a seat. In fact, it is important for the fabric to stretch under the weight of a person who is seated, but it is also important for the fabric to return to its initial smooth position so that it is attractive in appearance, even after intensive use (such as in the case of use in hotels, bars etc).

Furthermore, the use of chenille yarns in fabrics which are used in vehicle interiors has been proposed. Thus, patent applications US 2010/0227109 and JP 2003-328249 describe fabrics comprising chenille yarns woven with other yarns (respectively multifilament and sheathed), forming a fabric. The diameter of the other yarns is greater than the diameter of the support yarn for the chenille yarns. However, those fabrics do not have a sufficient abrasion resistance brought about by squashing during use under intensive conditions.

In general, a textile is subjected to ambient conditions, and in particular in the case of outdoor use, a textile can be degraded by bad weather, extreme temperature conditions or ultraviolet radiation. Textiles comprising flocked yarns are particularly resistant to environmental conditions.

SUMMARY OF THE DISCLOSURE

The Applicant has developed a woven textile comprising, in at least one of the warp or weft directions, non-flocked yarns and flocked yarns, the flocked yarns comprising a support yarn having a core covered with an adhesive layer, providing the support yarn with a base diameter, and protruding filaments providing said flocked yarns with an apparent diameter. In accordance with the described embodiments, the diameter of the non-flocked yarns is smaller than said apparent diameter and larger than said base diameter of said flocked yarns.

The woven textile advantageously overcomes the problems with the prior art, and in particular is very soft to the touch and has high abrasion resistance and stretch resistance.

Preferably, the flocked yarns are constituted by a support yarn. Preferably, the support yarn is essentially constituted by, more preferably is constituted by, a core covered with an adhesive layer.

In other words, the textile has, at least in one of the directions, the warp or the weft, preferably in only one of the directions, more preferably in the weft direction, a combination of flocked yarns and non-flocked yarns. The non-flocked yarns have a diameter which is larger than the diameter of the support yarn of the flocked yarns. In contrast, the filaments of the flocked yarns protrude beyond the plane in which the non-flocked yarns are located.

Because of the structure of the textile, the first contact that the user has with the textile is with the filaments of the flocked yarns. Thus, the user enjoys the softness of the material of the filaments of the flocked yarns and their resilient structure, and interest in using it is sustained. In the context of the disclosure, this property is sustained because the apparent diameter of the flocked yarns is greater than the diameter of the non-flocked yarns.

When the user exerts a pressure on the textile, the filaments are stressed and fold up against each other. The non-flocked yarns then take over and are subjected to the stress that is exerted and are responsible for the mechanical performance of the fabric. This also limits friction on the filaments and, as a consequence, the phenomenon of wear.

In general, a yarn is not perfectly cylindrical. In particular, when a yarn is woven, it is subjected to a stress due to the other yarns and has a tendency to become flattened. Thus, the term "diameter" should be understood to mean the average distance between the two points furthest from the centre of the yarn of each cross section of the yarn.

Following the same principle, the term "base diameter" means the diameter as defined above of the core and the adhesive layer of the flocked yarn. In other words, the "base diameter" is the average distance between the two points furthest from the centre of the support yarn of each cross section of the support yarn.

In an equivalent manner, the term "apparent diameter" should be understood to mean the average diameter of the cylinder in which the filaments are inscribed when the flocked yarn is not subjected to any stress and is in the initial state, i.e. before use of the textile. The filaments of the flocked yarns are not rigid, and as a consequence the apparent diameter of the flocked yarns is not fixed and may be subjected to substantial variations. Whatever the case, when the flocked yarn has filaments, the apparent diameter is always larger than the base diameter.

The support yarn (core and adhesive layer) of the flocked yarns is not subjected to direct stresses because the diameter of the non-flocked yarns is greater than the diameter of the core of the flocked yarns covered with an adhesive layer. As a consequence, under the effect of contact by the user, the filaments of flocked yarn fold over the support yarn and thus pass below the level of the adjacent non-flocked yarns, which then take up the essential part of the contact by the user; the phenomenon of pull-out of the filaments is substantially reduced because the stress exerted at the level of the surface of the adhesive layer is small.

These two properties are obtained together because the base diameter of the Hocked yarns is less than the diameter of the non-flocked yarns.

Because of the specific ratio between the diameters of the flocked yarns and the non-flocked yarns, the flocked yarns are protected by the non-flocked yarns and the overall abrasion resistance of the textile is better than the abrasion resistance of prior art textiles used in outdoor furniture, which are woven from a textile yarn with poorer performance as regards abrasion.

A clear advantage of the textile is the combination, in a single textile, of a pleasant feel, resistance to outdoor conditions, and in particular to ultraviolet radiation, and substantial abrasion resistance and stretch resistance. This quality does not exist in prior art fabrics obtained with chenille yarns. Thus, patent application US 2010/0227109 cited above indicates that, in order to prevent loss of fibres and to make the fabric dimensionally stable, the back face of the fabric must be covered with an adhesive resin (paragraph [0053]).

Because the aim of the disclosed embodiments is to obtain a soft surface which is resistant to outdoor conditions and resistant to abrasion and to stretching, it is necessary to optimize the protection of the flocked yarns while retaining the character of softness.

Thus, it is advantageous to find a compromise between softness and mechanical strength. In theory, the more flocked yarns a textile contains, the softer will be the textile, but the more non-flocked yarns the textile contains, the greater will be the mechanical strength of the textile.

Advantageously, the textile in accordance with the present description has a ratio of the number of non-flocked yarns, preferably sheathed, to the number of flocked yarns of less than or equal to 1, in the direction comprising the flocked yarns, preferably a ratio of less than or equal to 0.5, more preferably a ratio in the range 0.2 to 0.5. Clearly, this direction includes both flocked yarns and non-flocked yarns.

The woven textile in accordance with the present description may be woven in accordance with a tabby, twill or satin weave, as well as any of the variations of these weaves, using up to 20 heddle frames. The fabric may also be woven on a Jacquard loom. In practice, compared with a plain weave, better results in terms of the softness/abrasion resistance ratio have been obtained with a twill weave or a weave derived from a tabby weave such as, for example, plain rep, basket and louisine weaves, preferably basket and louisine, or a satin weave, and in general weaves in which the flocked yarn floats are the longest, emphasising the presence of the flocked yarns on the surface intended to receive contact.

In a particular embodiment, the textile in accordance with the present description is woven in accordance with a weave of the twill type which advantageously has a ratio in the range 3 to 8, and advantageously, the weave is of the 3×1 twill type.

In another embodiment, the textile in accordance with the present description is woven in accordance with a weave of the satin type having a ratio in the range 5 to 8, with a stepping of more than 1.

In another embodiment, the weave is of the louisine type, advantageously having a ratio in the range 2 to 8, and advantageously the weave is of the 2 thread louisine type.

The mechanical strength of the textile in accordance with the present description may be increased by weaving non-flocked yarns and/or flocked yarns having a core based on a multifilament yarn (Le, either the non-flocked yarns have such and such a core or the non-flocked yarns have such and such a core or both the flocked yarns and the non-flocked yarns have such and such a core). In this (these) case(s), the mechanical strength increases with the linear density of the multifilament yarn.

The mechanical strength of a yarn is also closely linked to its nature. Preferably, the core of the non-flocked yarns is of high tenacity polyester, polyvinyl alcohol, polyamide, polyvinylidene fluoride (PVDF), polyarylate, aramid or glass, alone or as a mixture. For the same reasons, the adhesive layer of the flocked yarns is advantageously an acrylic, acrylate, polyurethane, epoxy or neoprene adhesive.

A wide variety of flocked yarns may be incorporated into the textile in accordance with the present description. Advantageously, the core of said flocked yarns is polyamide and the adhesive layer is an acrylic adhesive.

The soft feel character of the flocked yarns is provided by the protruding filaments. An essential parameter in obtaining this property is the nature of the filaments and their linear density. Advantageously, said protruding filaments are polyamide filaments, PVDF filaments, polytetrafluoroethylene (PTFE) filaments, polyester filaments or acrylic filaments. Said filaments generally have linear densities of between 0.5 dtex and 11 dtex with a length of between 0.1 mm and 3 mm.

The textile in accordance with the present description may be used in many types of applications, both indoors and outdoors. For outdoor use, it is advantageous for the textile to have good weather resistance and ultraviolet radiation resistance. It is possible to obtain such properties with sheathed yarns with a thermoplastic material sheath as the non-flocked yarns, and from flocked yarns with an excellent resistance to ultraviolet radiation.

Thus, the non-flocked yarns are preferably sheathed yarns with a thermoplastic material sheath. Advantageously, the thermoplastic material is selected from the group comprising polyolefins, elastomers, polyvinyl chloride, silicones and fluorinated polymers, alone or as a mixture.

Weaving may be followed by at least one treatment, as is known to the person skilled in the art, provided that this treatment does not affect the desired properties of the textile in accordance with the present description. In certain cases, and in particular when the non-flocked yarns are sheathed yarns, thermo fixing may be carried out after weaving. Advantageously, this means that mechanical cohesion of the fabric can be augmented by at least partially locking the sheathed yarns with respect to each other.

The textile in accordance with the present description is particularly suitable for outdoor use. In particular, the textile may advantageously be used to manufacture furniture. Thus, the disclosed embodiments also concern outdoor furniture comprising a textile as described above.

In particular, the textile may be incorporated into an armchair or a garden chair. The textile may also be manufactured as a cushion cover.

In a particular embodiment, the textile/yarn is treated with a treatment which can increase its water repellency with a view to improving its moisture resistance and mould resistance properties

BRIEF DESCRIPTION OF THE FIGURES

The manner of carrying out the described embodiments as well as the advantages thereof will become apparent from the following description of embodiments made with reference to the accompanying figures, in which.

Clearly, the dimensions and proportions of the elements illustrated in FIGS. 1 to 4 have been exaggerated compared with reality and have been provided solely with the aim of facilitating comprehension of the contemplated embodiments.

DETAILED DESCRIPTION

Figure 1:
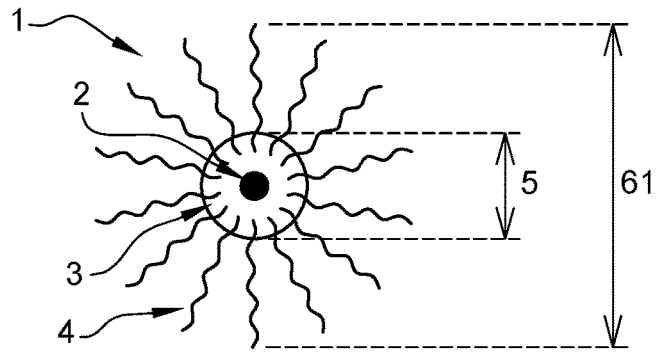
FIG. 1 diagrammatically represents a cross section of a flocked yarn.
Figure 2:
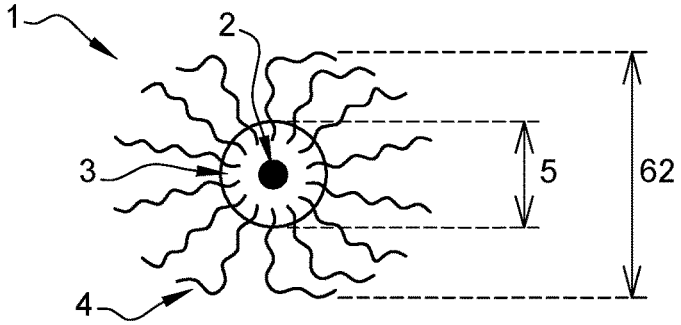
FIG. 2 diagrammatically represents a cross section of the flocked yarn of FIG. 1 in which the filaments are subjected to a stress, FIG. 3 diagrammatically represents a cross section of a non-flocked yarn, FIG. 4 diagrammatically represents a cross section of a textile, woven with the flocked yarn of FIG. 1 and the non-flocked yarn of FIG. 3.

As illustrated in FIGS. 1 and 2, the flocked yarn 1 intended to be woven into a textile has a core 2. As already mentioned, the core may be a monofilament or a multifilament yarn. This core 2 is completely covered with an adhesive layer 3. The base diameter 5 corresponds to the external diameter of the adhesive layer; in other words, the base diameter 5 corresponds to the diameter of the cylinder in which the entire core 2 and adhesive layer 3 are inscribed.

Filaments 4 protrude from the adhesive layer 3. A portion of each filament 4 is integrated into the adhesive layer 3, enabling the filaments 4 to key in.

In FIG. 1, the filaments 4 are not subjected to any stress and the apparent diameter 61 is a maximum. In FIG. 2, the filaments 4 are subjected to a small stress. The filaments 4 are slightly folded down on themselves. Visually, the flocked yarn 1 appears more flattened in FIG. 2 than in FIG. 1. The apparent diameter 62 is in fact reduced because of the stress exerted on the filaments 4.

Figure 3:
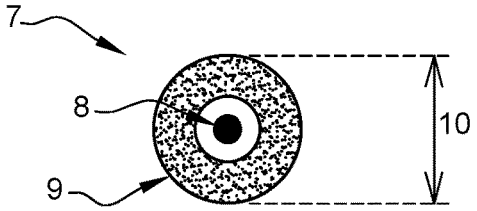

As illustrated in FIG. 3, the non-flocked yarn 7 intended to be woven into a textile is a sheathed yarn. The non-flocked yarn 7 has a core 8 which, as already mentioned, may be a monofilament or a multifilament yarn, and a thermoplastic material sheath 9. The diameter 10 of the non-flocked yarn 7 corresponds to the diameter of the cylinder in which the core 8 and sheath 9 assembly are inscribed.

Figure 4:
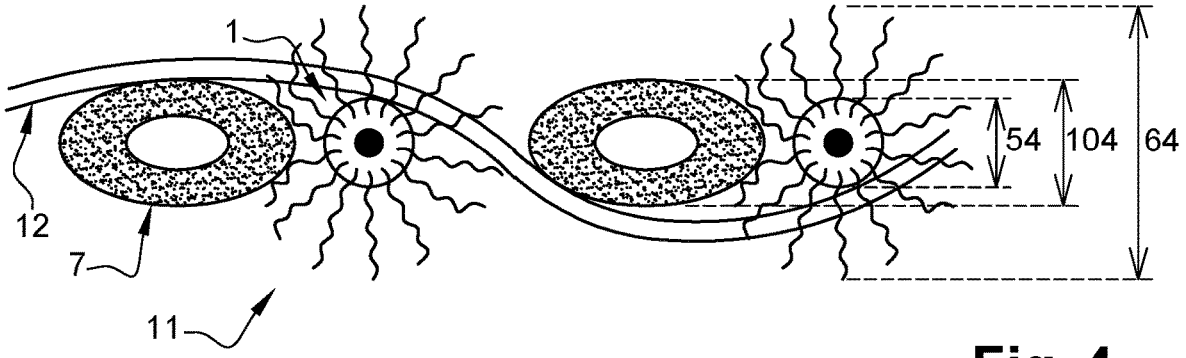

The textile 11 of FIG. 4 is woven with flocked yarns 1 and non-flocked yarns 7, and a yarn 12. The yarn 12 may be identical to or different from the non-flocked yarn 7. Although the textile 11 is more homogeneous if the yarn 12 is identical to the non-flocked yarn 7, it is advantageous for the yarn 12 to have a diameter which is smaller than the diameter 104 of the non-flocked yarn 7, so that the non-flocked yarn 7 can protect the flocked yarn 1 more effectively. Because they have been woven, the yarns 1, 7 and 12 are slightly flattened. This results hi the fact that the diameters 54, 104, 64 are slightly reduced compared with the diameters 5, 10, 61.

As already mentioned, the base diameter 54 is smaller than the diameter 104, which in turn is smaller than the apparent diameter 64. It is of no importance that certain areas of the filaments are overfilled or even squashed by the yarns 7 or 12. The apparent diameter 64 within the scope of the contemplated embodiments corresponds to the diameter of the overall cylinder in which the Hocked yarn 1 is inscribed. The quantity of filaments going beyond the crest of the yarns 7 and 12 is sufficient to provide the textile 11 with a soft nature.

First Exemplary Embodiment

A textile in accordance with the disclosed embodiments was woven in accordance with a 3×1 twill weave, with:

in the warp: a yarn with a diameter of 390 μm with a linear density of 1400 dtex, having a core of multifilament polyester with a diameter of 230 μm with a linear density of 280 dtex and a polyvinyl chloride sheath rendered fire-retardant with antimony trioxide and with an antifungal treatment, having a linear density of 1120 g/10000 m, in the weft; as the non-flocked yarns, yarns with a diameter of 480 μm with a linear density of 2000 dtex, having a core of multifilament polyester with a diameter of 300 μm with a linear density of 550 dtex and a polyvinyl chloride, sheath with an antifungal treatment, having a linear density of 1450 g/10000 m; as the flocked yarns, yarns with an apparent diameter in the range 1100 μm to 1400 μm with a linear density of 1563 dtex, having a core of polyamide covered with a water-based acrylic adhesive with a base diameter of 185 μm, wherein the filaments are polyamide 6.6 and have a linear density of 1.9 dtex, the flocked yarns having a linear density of 1328 g/10000 m.

The textile had 20 yarns per cm in the warp and in the weft, non-flocked yarns in an amount of 4.65 per cm and flocked yarns in an amount of 4.65 per cm.

A photograph of the textile in accordance with the disclosed embodiments as described above is reproduced in FIG. 5.

Figure 5:
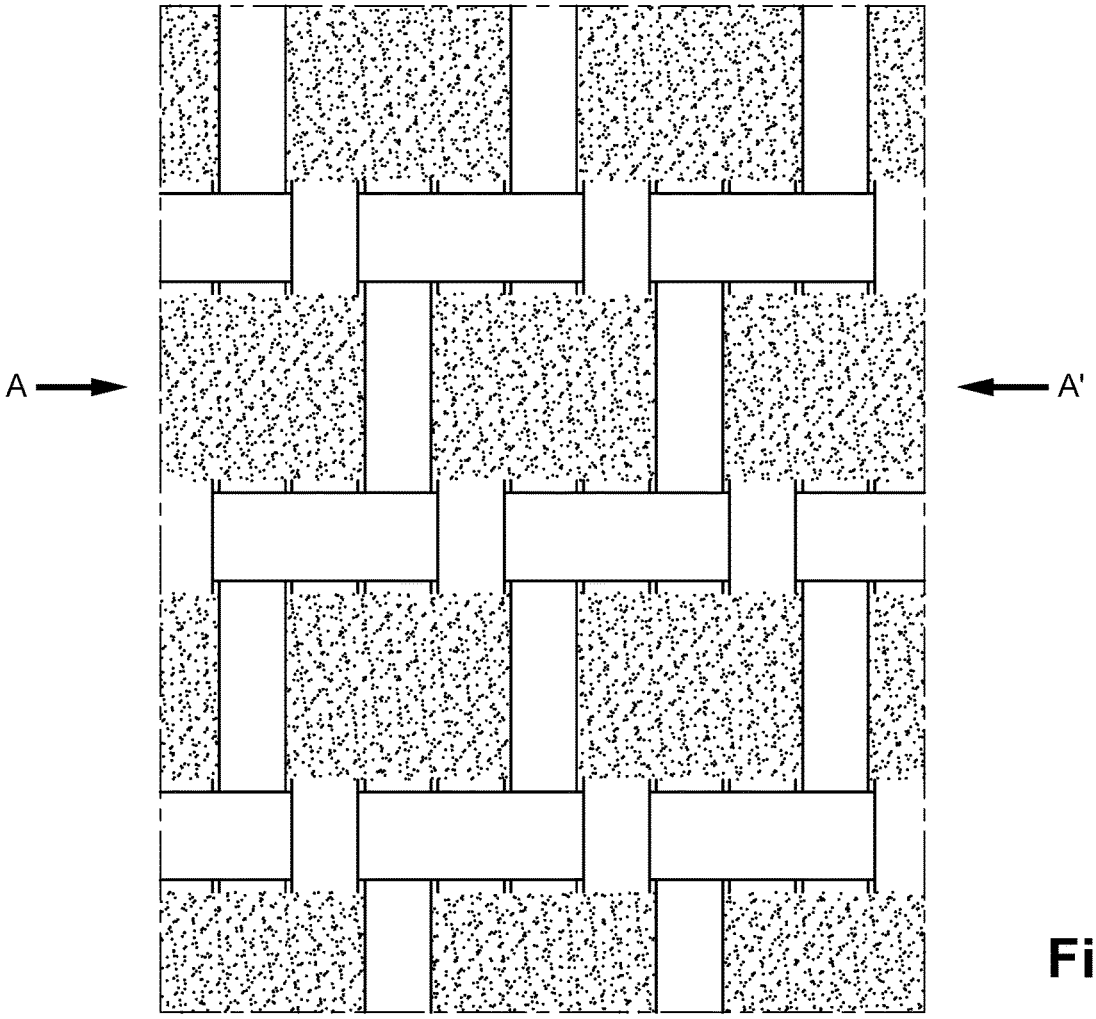
FIG. 5 is a photo of the face of a textile in accordance with a first embodiment, with a twill weave.
Figure 6:
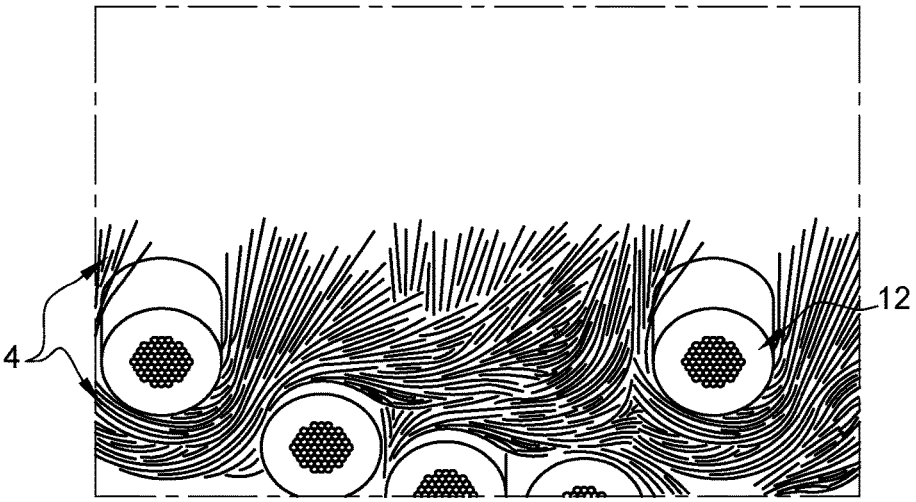
FIG. 6 is a photo of a cross section of the textile in the photo of FIG. 5 along the line AA'.

A photograph of a cross section, along the line AA' in the textile of FIG. 5 is reproduced in FIG. 6. In this photograph, it will be seen that the filaments 4 protrude beyond the yarn crests 12 by an average distance of 277 μm.

Second Exemplary Embodiment

A textile in accordance with the disclosed embodiments was woven in a louisine weave, with:

in the warp: a yarn with a diameter of 390 μm with a linear density of 1400 dtex, having a core of multifilament polyester with a diameter of 230 μm with a linear density of 280 dtex and a polyvinyl chloride rendered fire-retardant with antimony trioxide and with an antifungal treatment, having a linear density of 1120 g/10000 m, in the weft: as the non-flocked yarns, yarns with a diameter of 480 μm with a linear density of 2000 dtex, having a core of multifilament polyester with a diameter of 300 μm with a linear density of 550 dtex and a polyvinyl chloride sheath with an antifungal treatment, having a linear density of 1450 g/10000 m; as the flocked yarns, yarns with an apparent diameter in the range 1100 μm to 1400 μm with a linear density of 1563 dtex, having a core of polyamide covered with a water-based acrylic adhesive with a base diameter of 185 μm, wherein the filaments are polyamide 6.6 and have a linear density of 1.9 dtex, the flocked yarns having a linear density of 1328 g/10000 m.

The textile had 18.2 yarns per cm in the warp, and non-flocked yarns in an amount of 4.35 per cm and flocked yarns in an amount of 4.35 per cm in the weft.

Figure 7:
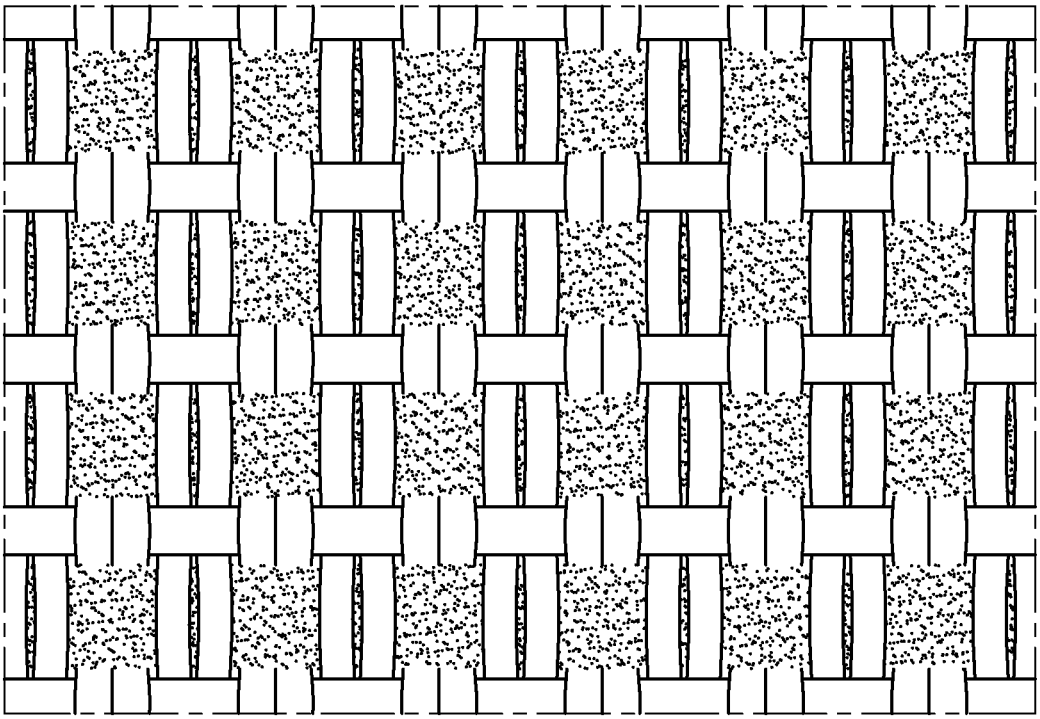
FIG. 7 is a photo of the face of a textile in accordance with a second embodiment, with a louisine weave.

A photograph of the textile in accordance with the disclosed embodiments as described above is reproduced in FIG. 7.

Softness Test for First Textile

A panel of 90 consumers of various ages comprising 30 men and 60 women, all users of outdoor furniture covered with fabric, compared the softness of the woven textile in accordance with the disclosed embodiments and commercially available fabrics, namely Sunbrella Natte® fabric, Sunbrella Linen® fabric and Batyline® fabric. The users provided a score out of 10. The results are reported in Table 1.

Abrasion Resistance Test for First Textile

The first textile woven in accordance with the disclosed embodiments, the Sunbrella Natte®, fabric, the Sunbrella Linen® fabric and the Batyline® fabric were tested using the Martindale test in accordance with the standard NF EN ISO 12947-2 (2 distinct threads broken). The results are reported in Table 1.

TABLE 1

| Fabric | Softness (score out of 10) | Abrasion resistance NF EN ISO 12947-2 (number of cycles to 2 broken threads) |
|---|---|---|
| Described Embodiments | 7.8 | >120000 |
| Sunbrella Natte ® | 7.3 | <20000 |
| Sunbrella Linen ® | 7.0 | <50000 |
| Batyline ® | 6.2 | >120000 |

The textile in accordance with the disclosed embodiments is the only one to have both good softness and a high abrasion resistance.

It should be noted that an abrasion resistance test (Martindale test) comparing two prior art fabrics produced with chenille yarns and a fabric in accordance with the disclosed embodiments produced with flocked yarns showed that the loss of thickness after 50 000 cycles is 4 times greater in the case of the prior art fabrics.

The invention claimed is:

1. A woven textile comprising, in at least one of the warp or weft directions, non-flocked yarns and flocked yarns, the flocked yarns comprising a support yarn having a core covered with an adhesive layer, the support yarn having a base diameter, and protruding filaments providing said flocked yarns with an apparent diameter, said non-flocked yarns having a diameter which is smaller than said apparent diameter and larger than said base diameter of said flocked yarns, wherein, in the direction comprising the flocked yarns, the textile has a ratio of the number of all non-flocked yarns to the number of flocked yarns of less than or equal to 1.

2. The textile as claimed in claim 1, wherein the textile is woven in accordance with a tabby, twill or satin weave, or any of the variations of these weaves, using up to 20 heddle frames.

3. The textile as claimed in claim 2, wherein the weave is of the twill type having a ratio in the range 3 to 8.

4. The textile as claimed in claim 2, wherein the weave is of the satin type having a ratio in the range 5 to 8, with a stepping of more than 1.

5. The textile as claimed in claim 2, wherein the weave is of the louisine type.

6. The textile as claimed in claim 1, wherein the non-flocked yarns and/or the flocked yarns have a core based on a multifilament yarn.

7. The textile as claimed in claim 6, wherein the core of said non-flocked yarns is of high tenacity polyester, polyvinyl alcohol, polyamide, polyvinylidene fluoride (PVDF), polyarylate, aramid or glass, alone or as a mixture.

8. The textile as claimed in claim 1, wherein said non-flocked yarns are sheathed yarns with a thermoplastic material sheath.

9. The textile as claimed in claim 8, wherein the thermoplastic material is selected from the group comprising polyolefins, elastomers, polyvinyl chloride, silicones and fluorinated polymers, alone or as a mixture.

10. The textile as claimed in claim 1, wherein the adhesive layer is an acrylic, acrylate, polyurethane, epoxy or neoprene adhesive.

11. The textile as claimed in claim 1, wherein the core of said flocked yarns is polyamide and wherein the adhesive layer is an acrylic adhesive.

12. The textile as claimed in claim 1, wherein said protruding filaments are polyamide filaments, polyvinylidene fluoride (PVDF) filaments, polytetrafluoroethylene (PTFE) filaments, polyester filaments or acrylic filaments.

13. Outdoor furniture comprising a textile as claimed in claim 1.

* * * * *